United States Patent [19]

Charlton et al.

[11] 4,005,817

[45] Feb. 1, 1977

[54] NOZZLE TYPE CENTRIFUGE

[75] Inventors: Andrew Paul Charlton, Stamford; Kenneth Dan Lewis, Wilton; Charles Arthur Willus, Bethel; Per Nyrop, Norwalk, all of Conn.

[73] Assignee: Dorr-Oliver Incorporated, Stamford, Conn.

[22] Filed: Sept. 18, 1975

[21] Appl. No.: 614,565

[52] U.S. Cl. ..... 233/22; 233/29; 233/32

[51] Int. Cl.[2] ..... B04B 1/12; B04B 11/08

[58] Field of Search ..... 233/21, 22, 19 R, 20 R, 233/20 A, 14 R, 14 A, 27, 46, 32, 29, 44, 3

[56] References Cited

UNITED STATES PATENTS

| | | | |
|---|---|---|---|
| 256,365 | 4/1882 | Petersen | 233/22 |
| 1,565,604 | 12/1925 | Molen | 233/22 |
| 2,106,964 | 2/1938 | Wells | 233/22 |
| 2,154,134 | 4/1939 | Millar | 233/22 |
| 2,242,713 | 5/1941 | Tholl | 233/22 |
| 3,279,689 | 10/1966 | Honeychurch | 233/14 R |
| 3,321,131 | 5/1967 | Cook | 233/22 |

*Primary Examiner*—George H. Krizmanich
*Attorney, Agent, or Firm*—Burtsell J. Kearns; Theodore M. Jablon

[57] ABSTRACT

A nozzle type centrifugal machine with provision for light and heavy phase overflow delivery from top and bottom respectively of the rotor bowl, and equipped with control devices operable for correctively shifting the location of the interface within the limits of the centrifugal separating zone located within the area surrounded by a stack of separating discs.

24 Claims, 14 Drawing Figures

FIG. 4
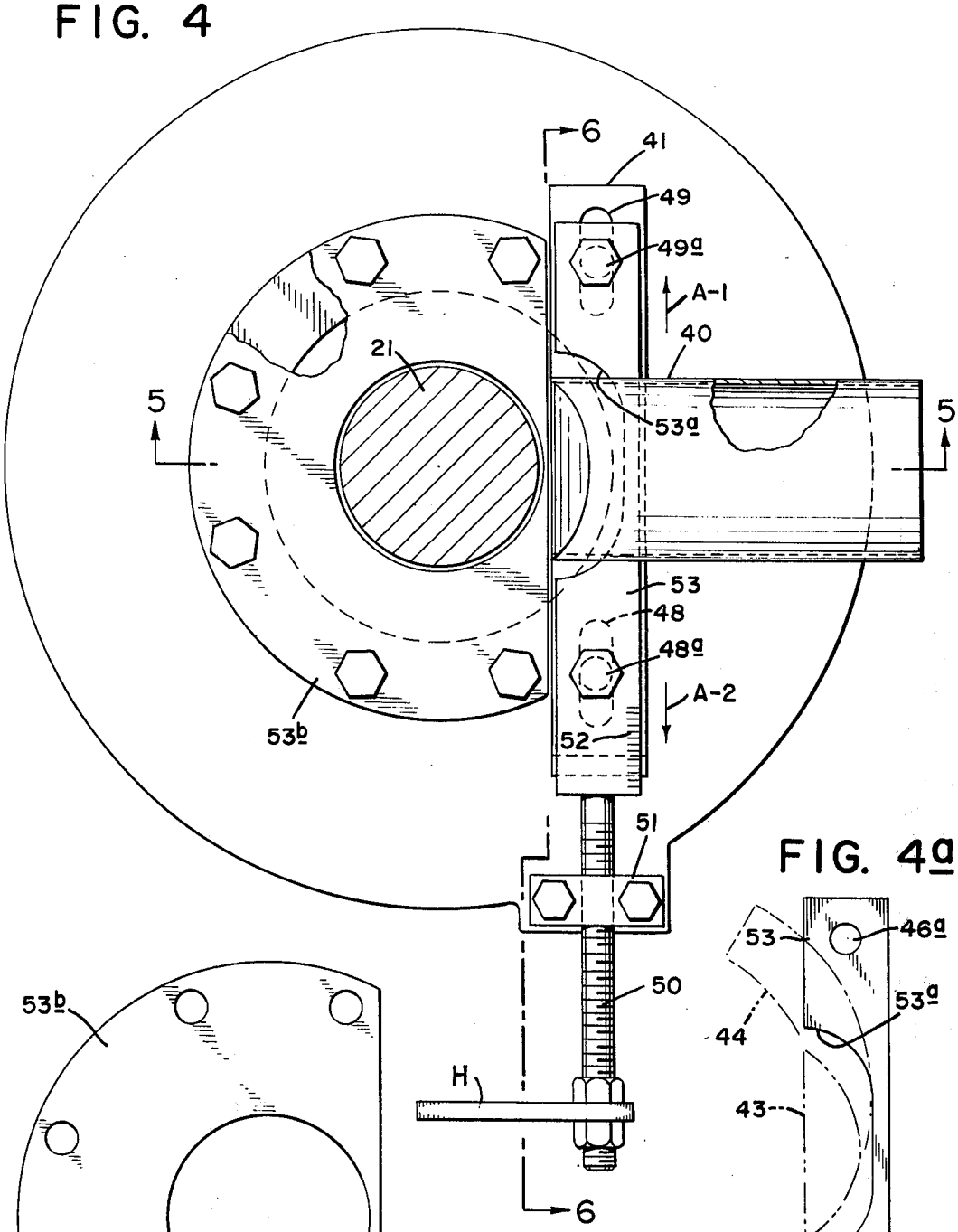
FIG. 4a
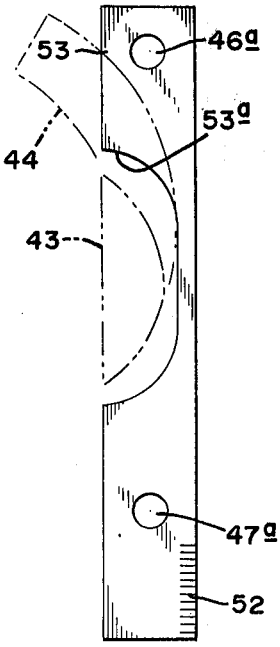
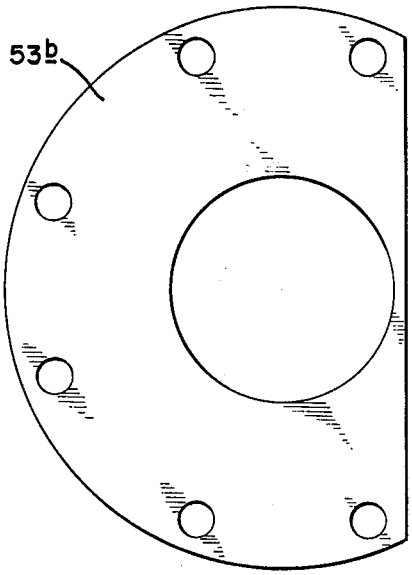
FIG. 4b

NOZZLE TYPE CENTRIFUGE

This invention relates to the two-phase separation of liquid mixtures involving operational problems similar to those encountered when raw syrup derived from the acid or enzymatic conversion of starch, is subjected to such separation.

As an example, therefore, this invention is concerned with subjecting the raw syrup or impure mixture to centrifugal separation producing the separated syrup as the heavy fraction, and the impurities or "mud" as the light fraction representing a by-product containing nutrient substances usable for instance as cattle feed.

A general object is to provide for this purpose a nozzle type centrifugal machine constructed and arranged so that a cleancut separation of the two fractions is attainable by controllably compensating for certain performance variations of fluctuations occurring in the course of operation of the machine. These controls should also prevent the light fraction or viscous mud from entering and plugging the stack of separating discs contained in the rotor bowl of this machine. Cleancut separation is also sought, in order to prevent light fraction substance from escaping with the syrup fraction, and thus from hampering a subsequent "polishing" filtration of the syrup fraction.

In a preferred embodiment of the invention, this separation is effected in a nozzle type centrifugal machine wherein the rotor delivers the light phase overflow fraction or mud at the top.

A ring dam or annular weir at the lower end of the rotor bowl discharges the syrup- or heavy fraction.

Intermediate these two opposedly directed overflow fractions, a portion of the syrup, along with stray solids discharge through the nozzles spaced along the outer periphery or widest intermediate portion of the double cone shaped rotor bowl, preventing undue accumulation or build-up of such substances in the bowl.

The heavy- or syrup fraction together with the nozzle discharge product, may be subjected to said "polishing" filtration preferably on a precoat type of rotary drum filter for delivering a clear syrup, while spent precoat material is being sent to waste.

In a preferred form of this invention, the centrifugal machine has a rotor shaft rising from a hub portion at the lower end of the rotor bowl. This hub portion divides the rotor bowl into a large centrifugal separating chamber above, and a much smaller feed chamber which receives the feed mixture through a central bottom opening.

There are feed openings or passages in said hub portion, allowing the feed mixture to pass from the feed chamber upwardly into an annular separating chamber surrounding the rotor shaft, effective to separate the heavy syrup fraction from the lighter scum or mud.

From the interface between the two fractions in said main centrifugal separating zone, the light fraction or mud containing the aforementioned impurities or by-product substances, moves inwardly towards the vertical axis of rotation, for delivery at the top of the rotor bowl, while the heavier syrup fraction moves from said interface outwardly through the stack of separating discs for additional polishing separation and into an annular zone or chamber surrounding the discs.

From this outer peripheral zone one portion of the polished syrup passes through downwardly converging ducts or transfer pipes for discharge via the aforementioned heavy fraction ring dam overflow, while another syrup portion carrying stray solids discharges peripherally through the nozzles.

In the operation of the above-outlined centrifugal nozzle type machine, the interface may shift inwardly or outwardly from a desired normal or intermediate postion. That phenomenon may be due to changes in the feed rate, or changes in the proportions between the light and heavy fractions in the feed mixture, or due to both changes occurring simultaneously. Other possibly concurrent causes may be changes in temperature, density or viscosity of the feed mixture.

For example, a condition requiring correction may be due to an increase in the feed volume or feed rate which in turn causes an increase in pressure drop or back pressure in the aforementioned heavy fraction discharge or transfer pipes. The thus resulting hydraulic imbalance between the two fractions or phases within the rotor produces a corresponding inward shift or contraction of the interface, thereby restoring the hydraulic equilibrium. However, an excessive inward shift of the interface may entail the loss of syrup in the light phase fraction or mud.

Conversely, a decrease in the feed rate would cause an outward shift or expansion of the interface. Excessive outward shift, in turn, would be tantamount to greater inventory accumulation of light phase material along with longer detention in the main separating zone. A resulting higher viscosity of the light phase fraction may tend to thwart or impede its take-off from the top end of the rotor bowl.

Therefore, it is a more specific object to provide a centrifugal nozzle type machine such as outlined above, in combination with control devices whereby the position of the interface is closely adjustable during operation, within the limits of the main separating zone. In this way, a desirable intermediate position of the interface can be restored in case of the occurrence of the aforementioned excessive or undesirable shifts or deviations.

To this end, in a preferred and practical embodiment of the invention, the following requisites are to be met suited for the separation of raw or impure conversion syrup a. Introducing the feed mixture from the bottom and through the feed holes in the hub portion of the rotor, the feed holes being located at a radius less than the inner radius of the stack of separating discs but greater than the radius of the interface, thus feeding into the heavy phase which is the continuous phase, so that the high-viscosiy light phase containing the impurities will not be disturbed.

By thus introducing the mixture into the separating zone surrounded by the discs, the major portion of the light phase is separated before the heavy phase passes through the discs, thereby preventing plugging of the discs by any light phase material, while allowing a minimum disc spacing for maximum separating capacity.

b. Removing said light phase material through an adjustable, tangentially curved scoop, whereby full advantage is taken of the centrifugal kinetic energy of the material, pushing it through an overflow discharge conduit connected to the scoop, and adjusting the position of the scoop.

Adjusting the scoop inwardly towards the axis of rotation will produce a corresponding outward shift or expansion of the interface. Conversely, adjusting the scoop outwardly away from the axis of rotation will produce a corresponding inward shift or contraction of the interface. The amount of such adjustments is indicated or dictated by the apparent condition of the respective overflows fractions, thereby avoiding either plugging of the discs in one direction, or else loss of syrup in the opposite direction.

c. Allowance to be made for a relatively wide range of adjustability of the interface within the main separating zone.

For that purpose, the main separating zone in the rotor is defined by an acceleration imparting spider structure of relatively large outer diameter, surrounded by the stack of separating discs having a correspondingly larger than usual inner diameter, and otherwise fitted into the remaining available annular space in the rotor bowl, surrounded by an outer peripheral secondary separating zone communicating with the nozzles.

d. Provision of a scoop device positionable relative to the light phase fraction to adjust the location of the interface, which scoop device is located closely adjacent to the rotor shaft, so that the overflow radii of the light and heavy fraction overflows can be minimized.

Features of the invention are found in the construction, manner of adjustability, and mode of operation of the scoop device as embodied in, or integrated into the bottom fed two-phase nozzle type centrifugal machine.

In a preferred embodiment, the scoop device comprises an horizontal scoop located within the top end portion of the rotor bowl, which has a neck extending upwardly through the top end of the rotor bowl close to the rotor shaft, and fixed to an horizontal guide block that is longitudinally shiftable for fine adjustment of the scoop position.

Other features and advantages will hereinafter appear.

IN THE DRAWINGS:

FIG. 1 as an example shows a simplified basic flowsheet of the invention as applied to the centrifugal fractionation of a raw or impure syrup derived from the acid- or enzymatic conversion of a starch.

FIG. 1*a* is an enlarged semidiagrammatic view of a nozzle type centrifugal machine embodying this invention, and of a precoat type of drum filter for the filtration of the syrup fraction delivered by the machine, combined with the nozzle discharge product from the centrifuge.

FIG. 4 is an enlarged top view of the scoop device, taken on line 4—4 in FIG. 2 or FIG. 3, including an indicator plate bearing graduations.

FIG. 4*a* taken from FIG. 4, is a detail plan view of the indicator plate.

FIG. 4*b* taken from FIG. 4, is a detail plan view of a specially shaped top closure flange for the machine.

Figure 5:
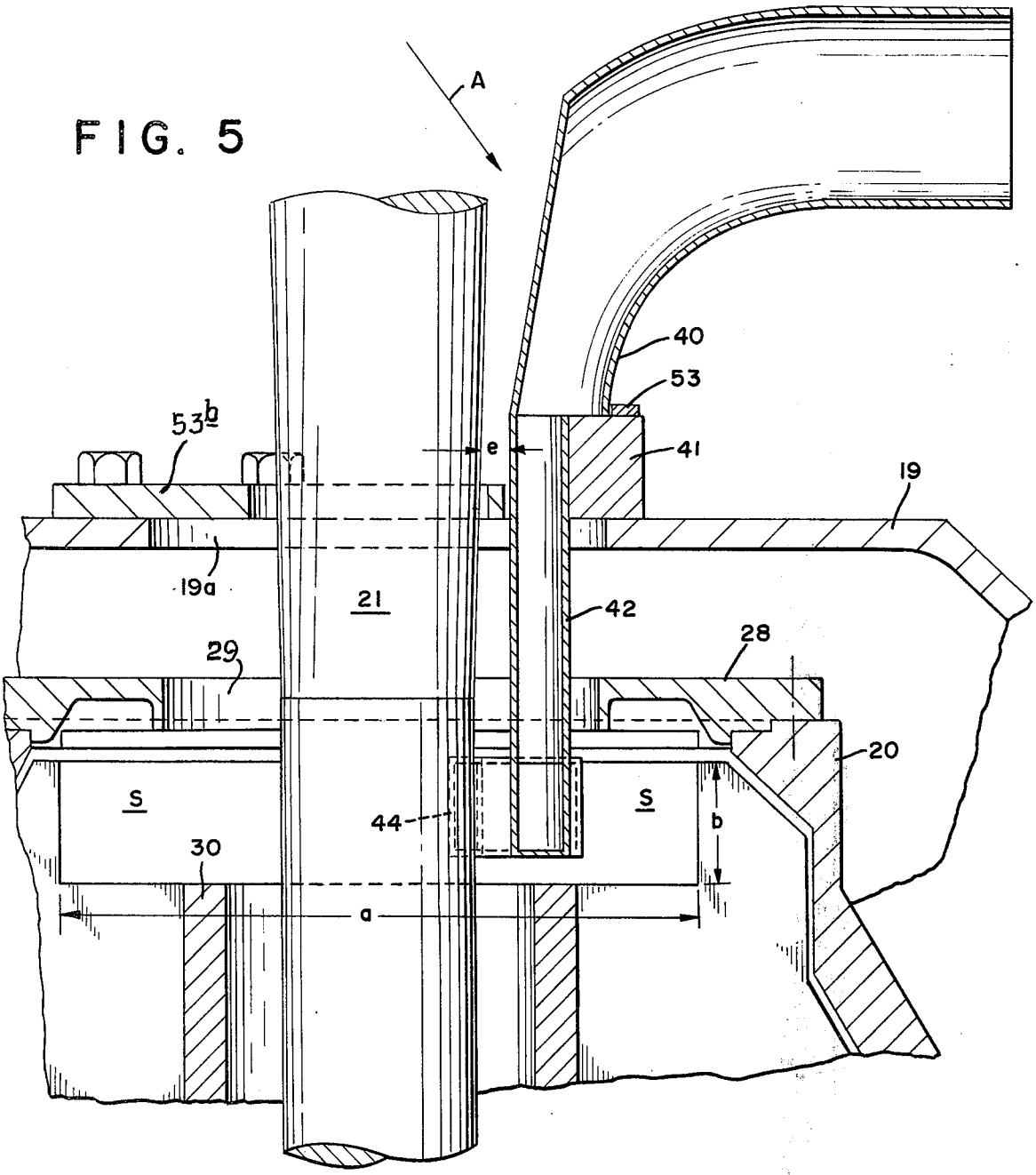

FIG. 5 is an enlarged vertical sectional detail view of the scoop device, taken on line 5—5 in FIG. 4.

Figure 5A:
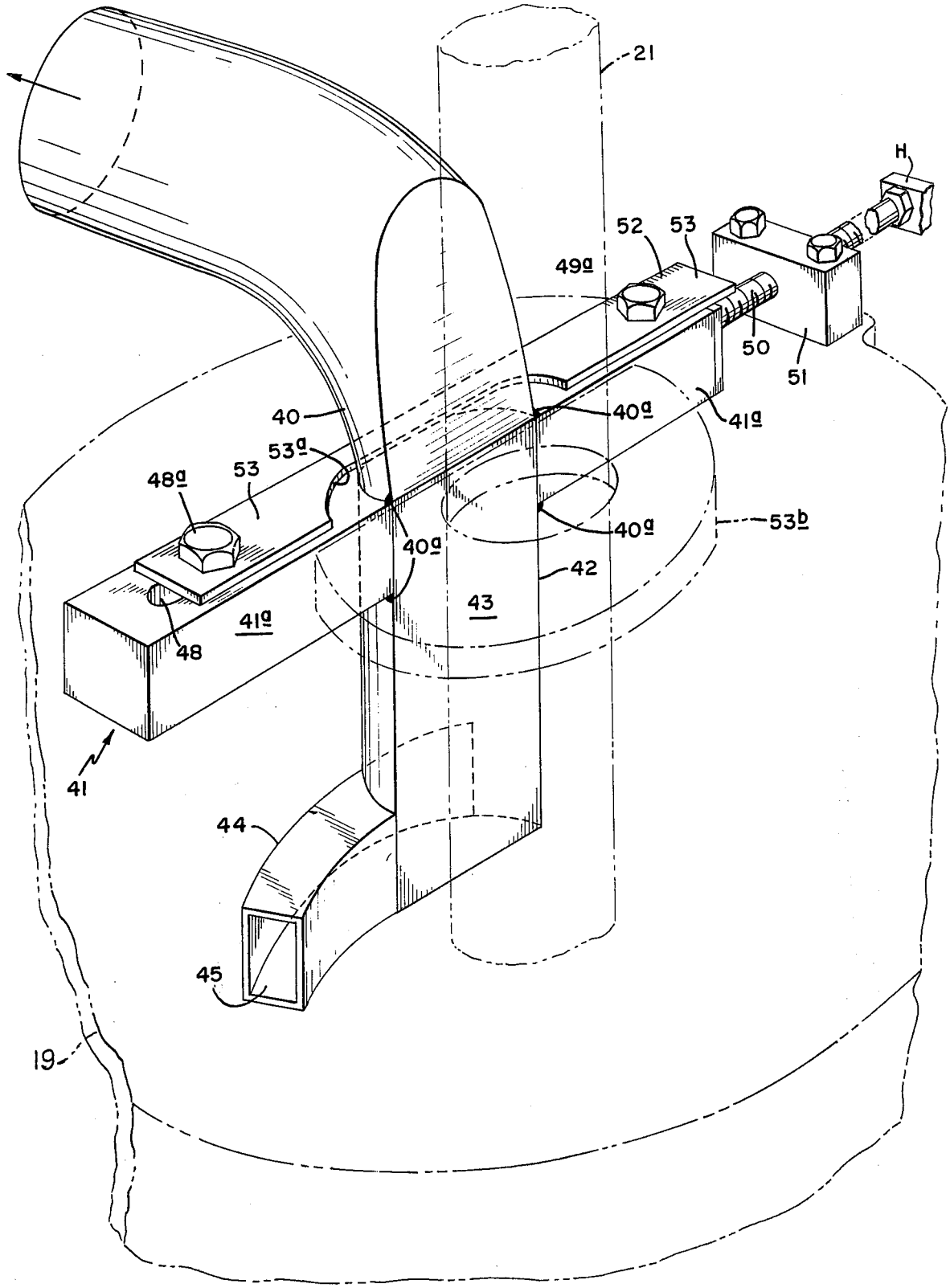

FIG. 5*a* is a perspective view of the scoop device and associated parts, as viewed in the direction of arrow "A" in FIG. 5.

Figures 6, 6A, 6B:
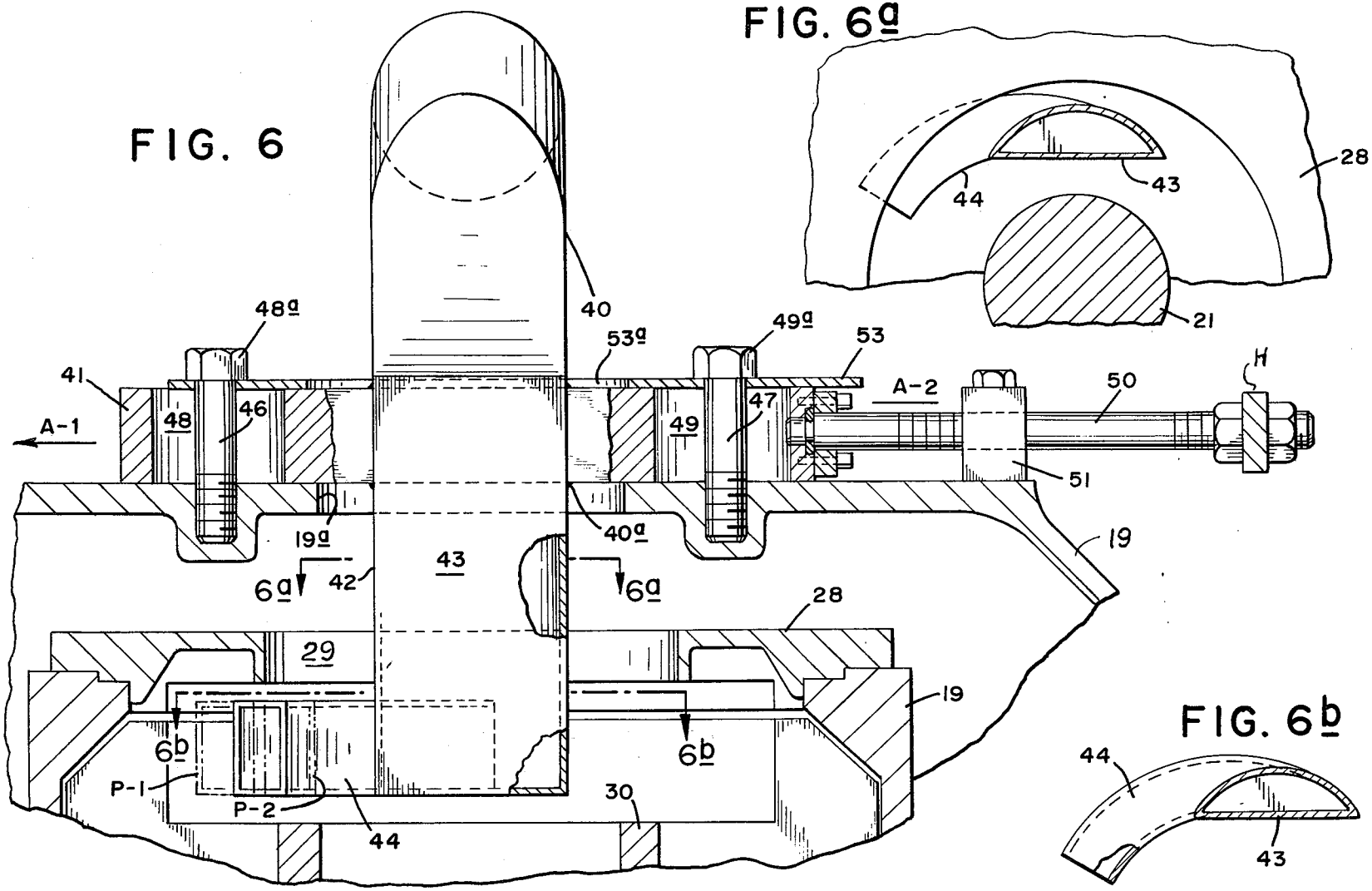

FIG. 6 is a vertical sectional view of the scoop device, taken on line 6—6 in FIG. 4.

FIG. 6*a* is a detail cross-sectional view of the scoop device, taken on line 6*a*-6*a* in FIG. 6.

FIG. 6*b* is another detail cross-sectional view of the scoop device, taken on line 6*b*-6*b* in FIG. 6.

Figure 7:
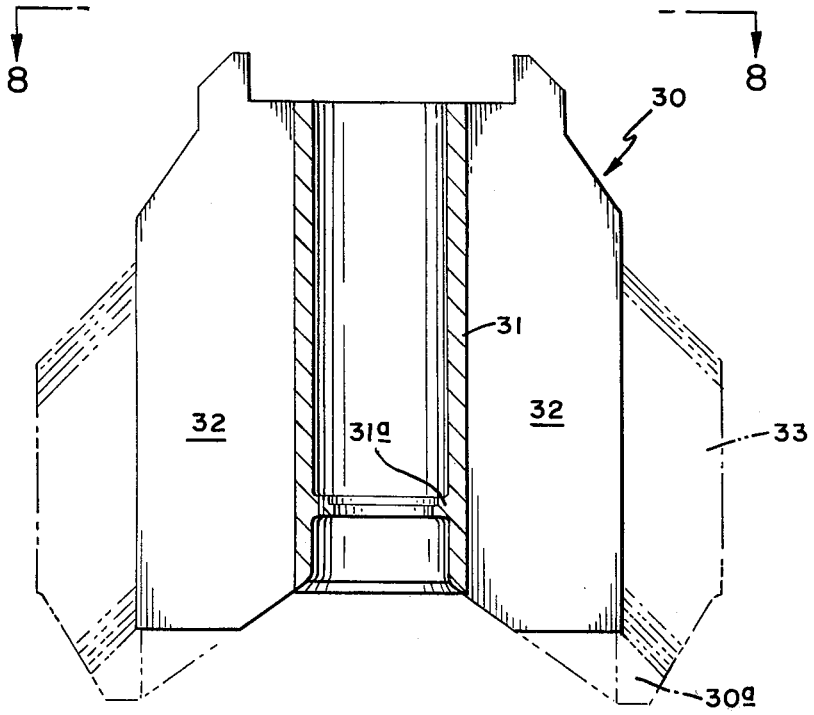

FIG. 7 is a vertical sectional detail view of the acceleration producing spider structure that occupies and defines the main separation zone in the rotor bowl.

Figure 8:
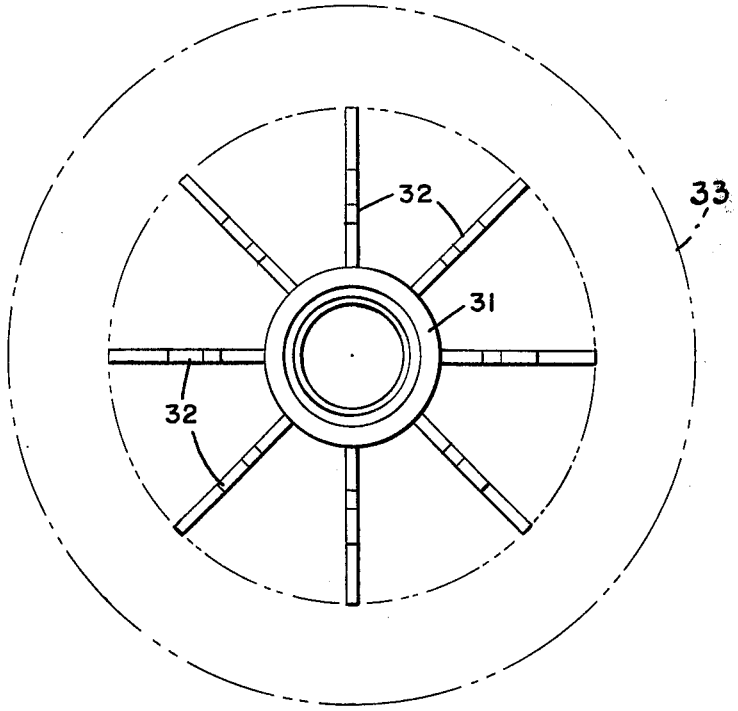

FIg. 8 is a top view of the spider structure taken on line 8—8 in FIG. 7.

Figures 1, 1A:
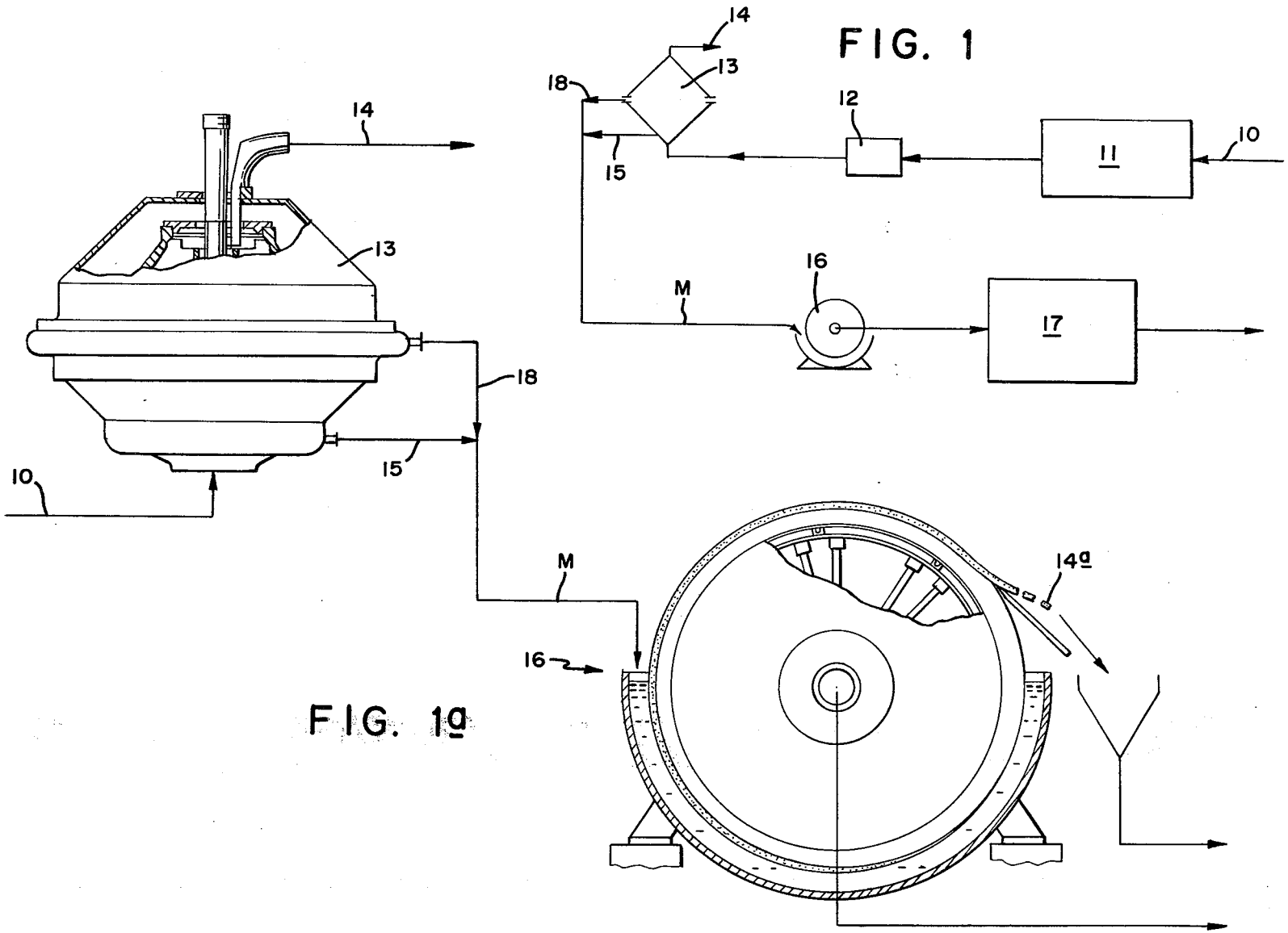

The flowsheet shown in FIG. 1 as an example, provides the background for one embodiment of the invention as applied to the centrifugal separation purification treatment of raw or impure syrup derived from the acid- or enzymatic conversion treatment of starch.

Accordingly, in this flowsheet, the starting material such as corn starch 10 is being fed to a digestion- or conversion station 11 to be subjected to acid or enzymatic digestive action. The resulting conversion product of raw impure syrup then passes through a pH adjustment station 12 in order to establish a pH at which some of the impurities such as the wax and the proteins will not go into solution. The thus conditioned mixture is supplied to a nozzle type centrifugal machine 13 which delivers a light phase overflow fraction 14 containing the impurities usable as cattle feed. A heavy phase overflow fraction or separated syrup 15 is delivered to a filter station 16 preferably a continuous rotary drum filter of the precoat type. The thus filtered syrup after passing through an activated carbon treatment station 17 for final "polishing" is then ready for shipment to the trade or the consumer.

A nozzle discharge product 18 combined with the syrup overflow of the heavy fraction, is subjected to filtration.

The above cooperative relationship of the centrifugal machine 13 and the precoat drum filter 16, appears enlarged in FIG. 1*a* showing the heavy phase fraction or bulk of the syrup overflow 15 being combined with the nozzle discharge product 18 for delivery as feed mixture M to the precoat filter unit 16, while light fraction or impurities overflow 14 is dispatched as cattle feed, and spent precoat material 14*a* goes to waste.

Figure 2:
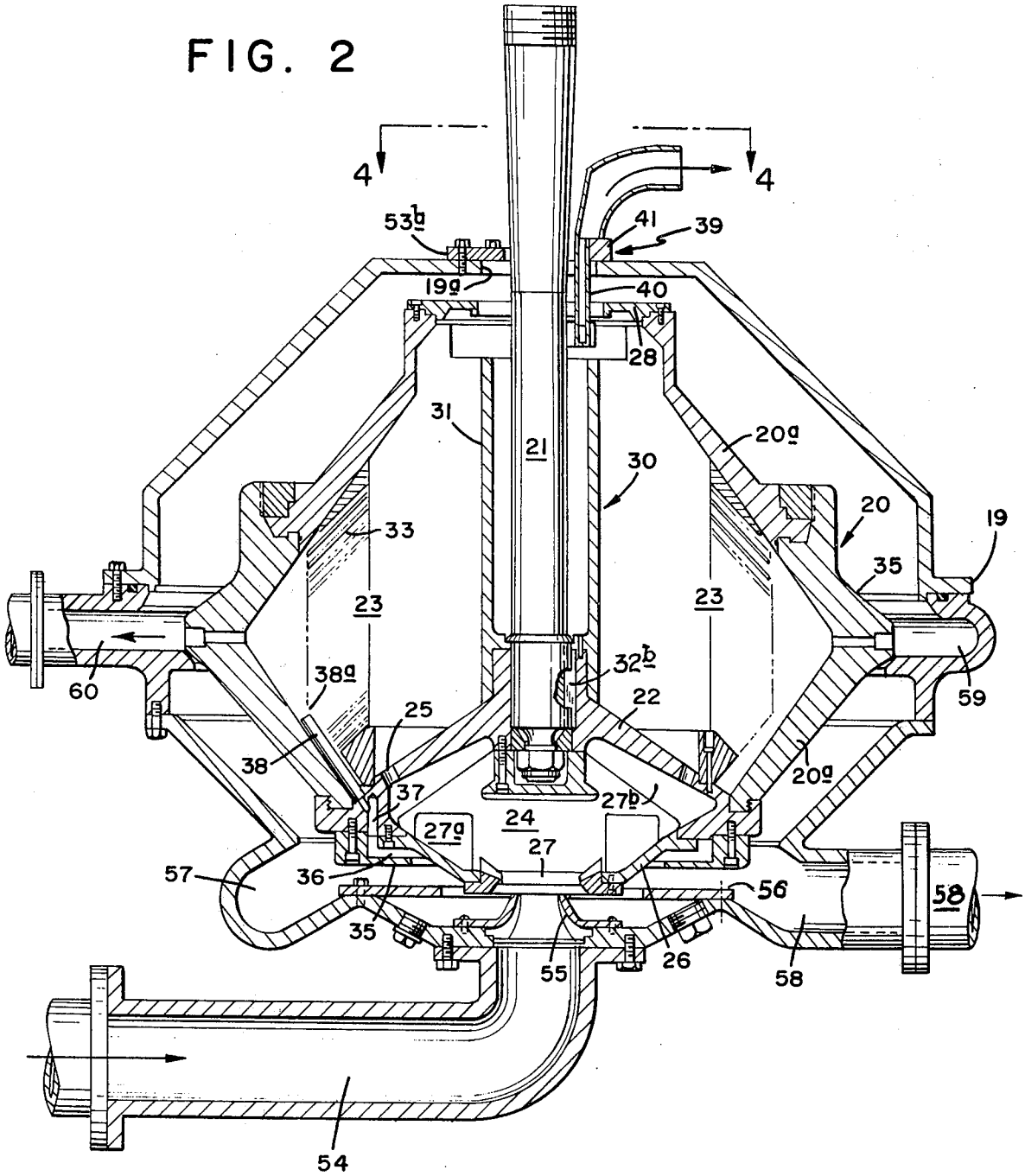
FIG. 2 is a vertical sectional view of the centrifugal nozzle type machine equipped with a light fraction take-off scoop device operable for controlling the location of the interface.
Figure 3:
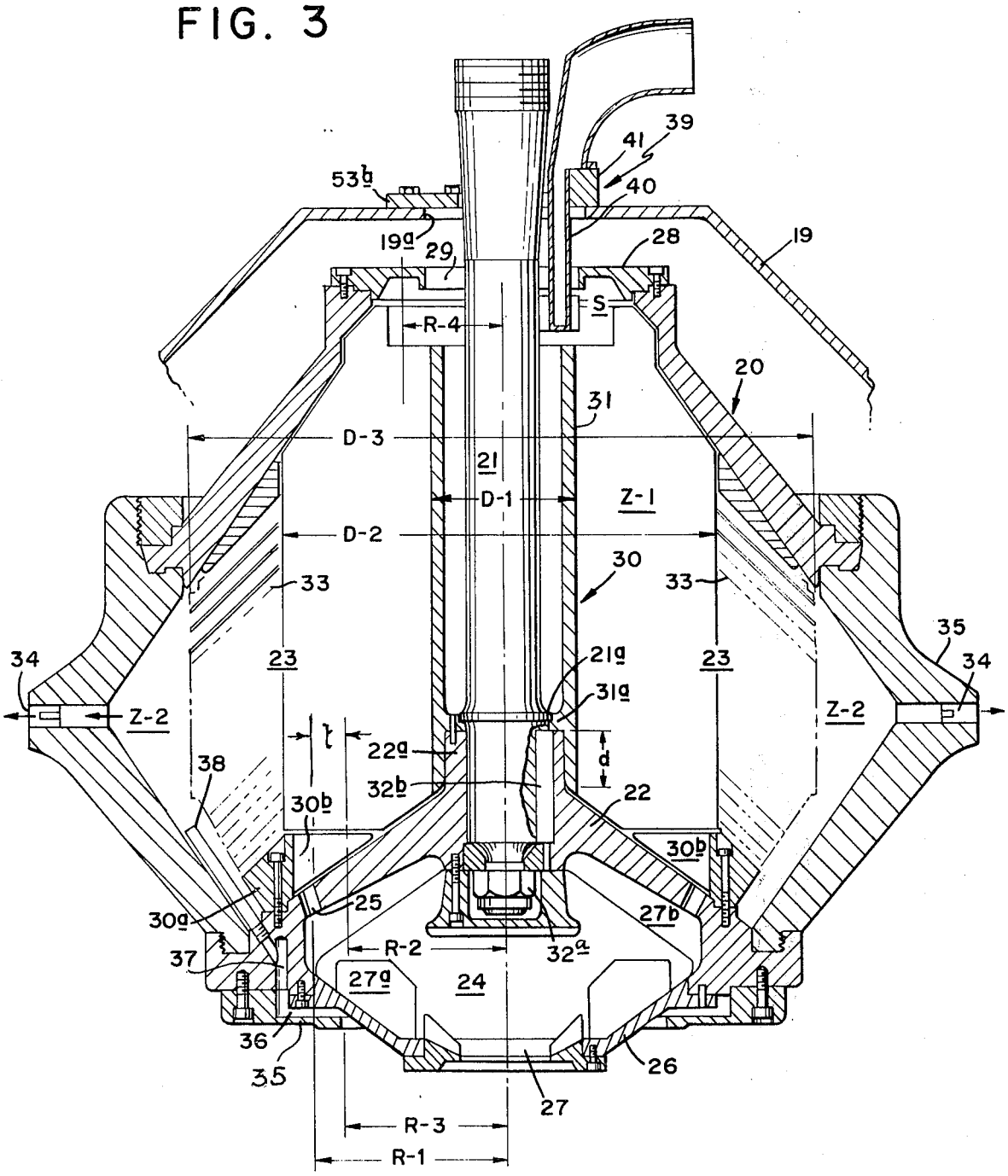
FIG. 3 is an enlarged view of the rotor, taken from FIG. 2, and shown associated with the scoop device.

Referring now to FIGS. 2 and 3 of the centrifugal machine embodying this invention, a stationary housing 19 concentrically surrounds a rotor 20 comprising a two-partite rotor bowl 20*a* of generally double-conical configuration. Internally of the rotor bowl, a rotor shaft 21 extends upwardly through a top opening of the housing from a transverse hub portion 22 rigidly connected to the lower end of the shaft. Being of obtuse upright conical configuration, this hub portion 22 divides the rotor bowl into a large upper centrifugal separating chamber 23 and a much smaller feed chamber 24 communicating with the separating chamber 23 through upward feed passages 25 provided in the hub portion 22.

The feed chamber 24 is constituted by the hollow of hub portion 22 and an inverted trunco-conical detachable companion member 26 having a bottom feed inlet opening 27. The companion member 26 has internal upstanding radial accelerator blades 27*a* cooperating with ribs 27*b* for imparting kinetic energy to the feed mixture.

Removably fastened to the top end portion of the rotor bowl is an annular inwardly overhanging flange 28 defining a top center opening 29 of the rotor bowl, through which the rotor shaft extends.

Within the separating chamber 23, a spider structure 30 (see also detail FIGS. 7 and 8) concentrically surrounds the rotor shaft, vertically confined between the hub portion 22 and the upper end portion of the rotor bowl.

The spider 30 consists mainly of a vertical tubular hub portion 31 of outer diameter D-1, concentrically surrounding the rotor shaft, with radial accelerator blades 32 extending radially from the tubular hub portion to an outer diameter D-2. The differential between diameter D-2 and D-1 defines a main or primary centrifugal separating zone Z-1.

From FIG. 3 it is seen that the tubular hub portion of the spider is formed with an internal shoulder 31*a* defining a lower tubular end portion "*d*" fitted over the cylindrical neck 22*a* of rotor hub. The internal shoulder 31*a* is held rigidly between neck 22*a* and a cooperating external shoulder 21*a* of the rotor shaft, due to tightening of a nut 32*a* upon the threaded lower end portion of the rotor shaft. In this way, the rotor shaft 21, the hub portion 22, and the spider 30 are connected rigidly and concentrially to one another in torque transmitting relationship through key 32*b*.

The spider 30 is closely surrounded by a stack of separating discs 33 defined by an outer diameter D-3. These discs in turn are surrounded by an annular peripheral or secondary separating zone Z-2 communicating with discharge nozzles 34 provided in the peripheral or widest portion of the rotor bowl, suitably spaced from one another along the periphery.

At the bottom of the separating chamber 23 there is bolted down a filler ring member 30*a* formed with radial inwardly extending triangular complementary accelerator blades 30*b* registering with the horizontal bottom edges of the vertical accelerator blades 32 of the spider structure 30. Serving a dual purpose, the filler ring member 30*a* is also shaped to provide bottom support for the stack of separating discs.

From FIG. 3 it is further noted that the feed passages 25 are disposed along the periphery of the rotor hub portion 22, suitably spaced from one another, and thus located an ample radial distance R-1 from the axis of rotation. This places the feed passages in a position adjacent to the outer limit of the main centrifugal separating zone Z-1, but also within the annular area surrounded by the separating discs. For the sake of attaining optimum separating effect, the feed openings 25 are thus located at said radial distance R-1 significantly greater than the radial distance of the interface that may be variably located somewhere midway in said main separating zone Z-1, and tentatively designated by the radial distance R-2.

The remaining available volume of the separating chamber 23, surrounding the amply dimensioned or diametrically oversized spider 30 alias main separating zone Z-1, is suitably allotted to the stack of separating discs and to the peripheral or secondary separating zone Z-2 surrounding it. With this allotment a balance is struck between the minimum volumetric space required for the separating zone Z-2 and the space left available to accommodate the discs.

The lower end portion of the rotor bowl has removably fastened thereto a ring dam member 35 surrounding the aforementioned feed chamber 24 in concentrically spaced relationship therewith. This ring dam member presents the heavy phase fraction overflow tentatively indicated by radius R-3 which is greater than the radial distance of the light phase fraction overflow tentatively designated as R-4.

The word "tentative" as herein applied to radial distances is intended to mean that the respective radial distances represent average conditions or functional relationships, but are subject to variations or fluctuations incident to the operation of the machine, or subject to adjustments indicated by such fluctuations.

The ring dam member 35 and the feed inlet chamber 24 or member 26 between them constitute an annular heavy phase overflow chamber 36. Individual passages 37 spaced equidistantly apart, lead upwardly from said annular chamber 36, to connect with the respective lower ends of the downwardly converging transfer pipes 38 through which passes the heavy phase fraction centrifugally displaced from the outer separating zone Z-2. These pipes therefore are shown to be of a length such that the upper or influent end 38*a* thereof is located substantially at the inner periphery of said outer centrifugal separating zone Z-2, and thus adjacent to the outer periphery of the separating discs.

As will be noted from FIGS. 3, 5, and 6 the top end portion of spider 30 has a central circular cutout with letter *a* designating the diameter and letter *b* designating the depth thereof. Together with the aforementioned annular inwardly overhanging flange 28, this cutout provides an annular space S for the accommodation and functioning of a stationary scoop device 39 through which the light phase overflow portion is to be removed subject to the kinetic energy imparted thereto by centrifugation.

The scoop device 39 for light fraction take off, integrated into the above discribed nozzle type centrifugal machine, comprises a multi-angled discharge conduit 40 fixed by weld connections 40*a* (see FIGS. 5*a*) to an horizontally elongate guide block 41 mounted for longitudinal sliding movement atop the housing 19 of the machine, and located closely adjacent to the rotor shaft.

The discharge conduit 40 destined for the removal passage therethrough of the light phase fraction, comprises an intermediate vertical portion 42 shown to be of substantially half round cross-sectional configuration, thus presenting a vertical flat face 43. This intermediate vertical conduit portion is countersunk into the inner side of guide block 41 so that the flat face 43 is flush with the inner side face 41*a* of the block. This places the flat face 43 or conduit portion 42 close to the rotor shaft in a near or pseudo tangential relationship therewith as indicated by the small intervening distance *e* in FIG. 5.

The closed bottom end of the vertical conduit portion 42 has a lateral duct extension 44 of tangentially scoop shaped curvature extending in a horizontal plane. This lateral extension or lower end portion 44 of the discharge conduit has an influent opening 45 facing in a direction opposite to the direction of rotation of the rotor bowl. This lateral extension or scoop thus reaches into a potential annular zone or inventory of light phase fraction centrifugally contained within an area surrounded by the interface. With feed mixture continually entering the machine, and with the scoop in a suitably adjusted position relative to this light fraction inventory, kinetic energy will cause the light fraction material tangentially entering the scoop to be pushed or displaced upwardly through discharge conduit 40 for delivery from the machine.

Longitudinal guidance of the guide block 41 is provided by a pair of upright guide bolts 46 and 47 threaded into the horizontal top portion of the housing 19 of the machine. These bolts extend upwardly through, and cooperate in guide relationship with a corresponding pair of elongate openings or slots 48 and 49 longitudinally coextensive with the block. These guide openings or slots are provided in respective end portions of the block with the aforementioned light fraction discharge conduit 40 located midway therebetween.

A desired fine adjustment of the scoop position inwardly or outwardly with resultant change in the position of the interface, is attainable due to the provision of an horizontal spindle 50 connected coextensively or coaxially to one end of the horizontal guide block 41, and turnable in a stationary threaded bearing block 51, as indicated by handle H.

The amount of such adjustment can be measured and observed by noting the amount of longitudinal guide block movement relative to graduation 52 provided on a cover plate 53 held stationary by said pair of guide bolts 46 and 47 penetrating the cover plate through fitted holes 46*a* and 47*a* (see FIG. 4*a*). These bolts have heads 48*a* and 49*a* which together with the fitted holes retain the cover plate stationary in position although in sliding contact with the top face of the block. The graduated cover plate 53 has a lateral elongate cutout 53*a* accommodating the lateral movement of vertical discharge pipe 40 incident to the operation of the scoop device 39.

Thus, moving the guide block 41 in the direction of arrow A-1, will shift the scoop outwardly to a position P-1 indicated in dot-and-dash, causing a corresponding inward shift or contraction of the interface. (see FIG. 6)

Conversely, moving the guide block in the opposite direction indicated by arrow A-2, will shift the scoop inwardly to a position P-2 indicated in dot-and-dash causing a corresponding outward shift or expansion of the interface.

Referring to FIG. 2, the pattern of flow through the machine is as follows:

With the rotor turning at the required centrifugation speed, feed mixture or impure syrup is supplied by feed pipe 54 terminating upwardly in a nozzle 55. This nozzle injects the feed mixture centrally upward into the feed chamber 24 of the rotor bowl, there to be subjected to centrifugal acceleration by the blades 27*a* and ribs 27*b*. This forces the mixture through the feed holes 25 into the main separating zone Z-1 for separation into the light and the heavy phase fraction as defined against each other by the interface.

The light fraction is delivered through take off by the scoop device 39. The heavy fraction after undergoing further separation through the stack 33 of separating discs, discharges through the downwardly converging set of transfer pipes 38, then via ring dam 35, and past an annular baffle 56 into an annular collecting channel volute 57 of the machine housing, having a discharge connection 58.

A partial cover flange 53*b* closes the top opening 19*a* of housing 19, but is shaped in a manner (see FIGS. 4, 4*a*, and 5) to accommodate the control device 39 located closely adjacent to the rotor shaft.

The nozzle discharge product containing the minor portion of the heavy phase fraction or syrup along with stray solids from the peripheral separating zone Z-2, is delivered into an annular collecting channel or volute 59 of the machine housing for exit through discharge connection 60.

Reverting now to the aforementioned structural and functional correlation of the feed openings 25, and spider 30 containing the separating zone Z-1, the stack of separating discs, and the secondary or peripheral separating zone Z-2, it will be seen that ample opportunity is provided for attaining effective primary centrifugal separation by way of the amply dimensioned main separating zone Z-1. Similarly, ample potential is thus also afforded in this zone for controllably shifting the interface either outwardly or inwardly within that zone by means of the overflow control device 39, as dictated by the aforementioned fluctuations in the performance of the machine.

Illustrating the above control measures available by this invention, there is indicated in FIG. 3 an intermediate or average location of the interface defined by the radius R-2 as related to the radial distance R-1 of the feed openings 25. Thus, there remains available a substantial differential *t* as between the radii R-1 and R-2, representing a safety zone for the radius R-3 of the heavy phase fraction overflow via-ring-dam 26.

We claim:

1. A nozzle type centrifugal machine with a vertical axis of rotation, operable for effecting the separation of a feed mixture into a light and a heavy fraction and a nozzle discharge product, comprising a rotor having an upper open end, and a rotor shaft extending upwardly through said upper end, said rotor constructed and arranged for delivery of a light fraction from said upper end, and for overflow discharge of a heavy fraction at the lower end, and provided with nozzles spaced along the periphery intermediate said upper and lower ends for delivery of a nozzle product, and furthermore having a bottom feed opening for the introduction of said feed mixture into the rotor centrally from below, a stationary housing surrounding said rotor, having a top opening, separate means for separately collecting and discharging said heavy fraction overflow and the nozzle discharge product respectively, and a supply connection at the bottom for introducing said feed mixture upwardly into said bottom feed opening of the rotor, and a light fraction take off scoop device comprising a take off conduit member extending through said top opening of the housing into said rotor, and formed with a lateral scoop portion at the lower end, arranged for skimming off an inner layer of said light fraction, while allowing the kinetic energy resulting from angular velocity to push such skimmed off light fraction material upwardly through said conduit member to discharge, an elongate slide block fixed to the intermediate portion of said take off conduit member, and slidable longitudinally atop said housing, each end portion of said slide block having a longitudinally elongate vertical guide opening, a pair of upright bolts extending upwardly from said housing through respective elongate guide openings in guiding relationship therewith incident to longitudinal sliding movement of said block, said bolts having head portions preventing upward displacement of said block, said conduit member being unitary with said block thus being movable bodily on said housing parallel to itself in a horizontal plane, for adjustment of the skimming position of said scoop portion relative to said light fraction.

2. The machine according to claim 1, with the addition of means for controllably effecting said adjustment of the skimming position of said scoop portion.

3. The machine according to claim 1, with the addition of adjusting means comprising screw spindle means turnable for effecting adjustment of said scoop portion.

4. The machine according to claim 1, wherein said take off conduit member is countersunk into the lateral inner face of said block.

5. The machine according to claim 1, wherein said light fraction take off scoop device further comprises an elongate cover plate in sliding contact with the top face of said block, and having a pair of openings penetrated by said bolts in fitted relationship therewith, whereby said cover plate is held in place relative to the movement of said block, and actuating devices combined with indicator means for applying controllable fine adjustment to said block, said indicator means comprising graduations provided on said coverplate, arranged to indicate the amount of longitudinal movement of said block relative to said graduations.

6. The machine according to claim 1, wherein said light fraction take off scoop device further comprises actuating means combined with indicator devices for applying controllable fine adjustment movement to said block.

7. The machine according to claim 1, wherein said light fraction take-off scoop device further comprises a screw spindle having its inner end turnably connected to one end of said slide member, horizontally coextensive therewith, and an internally threaded bearing block cooperating with said spindle to effect longitudinal movement of said slide member, controllable by the turning of said spindle.

8. The machine according to claim 1, wherein said take off conduit member for said light fraction is countersunk into the lateral inner face of said block, and shaped so as to present a flat face substantially coextensive with said inner lateral face of the block, and located adjacent to said rotor shaft.

9. The machine according to claim 1, wherein said light fraction take off scoop device further comprises and elongate cover plate in sliding contact with the top face of said block, and having a pair of openings penetrated by said bolts in fitted relationship therewith, whereby said cover plate is held in place relative to movement of said block.

10. A nozzle type centrifugal machine constructed for effecting the two phase separation of a feed mixture into a light fraction product and a heavy fraction product as well as a nozzle discharge product, which comprises a double cone shaped rotor bowl having a vertical axis of rotation, and having an upper upright conical portion provided with an upper open end, a lower inverted conical portion, the juncture of said upper and lower conical portions constituting an intermediate peripheral wide portion having discharge nozzles spaced along the periphery, an internal hub portion dividing the rotor bowl into a large upper centrifugal separating chamber occupying the upper portion of the bowl including said wide portion, and having an open top end for delivery therethrough of the light fraction, and a much smaller feed chamber for said feed mixture, occupying the lower end portion of the bowl, and having a bottom feed opening for the introduction of said feed mixture, said hub portion having feed openings spaced from one another about the rotor axis, said feed openings allowing for passage of said feed mixture from said feed chamber upwardly into said separating chamber, a rotor shaft extending from said hub portion upwardly through said upper open end of the rotor bowl, a spider structure having a cylindrical body portion provided with radial accelerator blades, concentrically surrounding the rotor shaft in fixed relationship therewith, said vertical accelerator blades extending radially from said body portion and having vertical outer terminal edges, the radial extent of said accelerator blades defining a primary centrifugal separating zone including said feed openings, said primary separating zone adapted during centrifugal activation thereof to contain an inner inventory of light fraction and an outer inventory of heavy fraction material surrounding said light fraction material, both said inventories being definable against each other by an interface, a stack of annular separating discs surrounding said spider structure and fitted over said vertical edges of the accelerator blades, and representing a secondary centrifugal separating zone surrounded by a peripheral receiving zone communicating with said discharge nozzles, said secondary separating zone effective during centrifugal activation, to repel residual entrapped light fraction material from the heavy fraction back into said primary separating zone and thus towards integration into said inner inventory of heavy fraction material, while delivering the light fraction material freed of said entrapped light fraction material outwardly into said peripheral receiving zone for discharge through said nozzles, delivery means for heavier fraction material produced in excess of the portion discharged by the nozzles, said delivery means comprising a ring dam member surrounding said feed chamber and said bottom feed opening thereof, and constituting with said feed chamber an annular receiving chamber for heavy fraction material, and means for transmitting flow of said heavy fraction material from said peripheral receiving zone to said annular receiving chamber for delivery across said ring dam member, a stationary housing surrounding said rotor bowl, having a top opening through which said rotor shaft extends, said housing formed with an intermediate collecting channel surrounding said nozzles, provided with discharge means for the heavy fraction overflow, and having feed means arranged for injecting said feed mixture upwardly through said bottom feed opening of the rotor into said feed chamber.

and a take off scoop device for the lighter fraction supported on said housing, and comprising a take off conduit member extending through said top opening of the housing into the top end of said rotor bowl, and formed with a lateral scoop portion at the lower end, arranged for skimming off an inner layer of said light fraction inventory, while allowing centrifugal force to push such skimmed off material upwardly through said conduit to discharge, said scoop device further comprising support means for said take off conduit member, constructed and arranged for rendering said conduit member movable horizontally on said housing, so as to be adjustable to skimming positions inwardly or outwardly for thus controllably maintaining an intermediate position of said interface spaced radially inwardly from said feed passage openings thereby to avoid commingling of the feed mixture rising through said feed openings with the light fraction inventory, said take off conduit member being movable outwardly to effect inward shifting of said interface with concurrent decrease of the outer heavy fraction inventory and corresponding increase of the inner light fraction inventory, and vice versa, whereby there is attainable a balanced condition as between said light fraction and said heavy fraction inventories, adapted to prevent escape of light fraction material into the heavy fraction product and of heavy fraction material into the light fraction product.

11. The machine according to claim 10, with the addition of positive control means for controllably effecting said adjustment of the skimming position of said scoop portion.

12. The machine according to claim 10, with the addition of adjusting means comprising screw spindle means turnable for effecting adjustment of said scoop portion.

13. The machine according to claim 10, wherein said support means for the scoop device comprise an elongate horizontal slide block fixed to the intermediate portion of said take off conduit member, and means for guiding said slide block longitudinally along a predetermined horizontal path, and wherein said take off conduit member is countersunk into the lateral inner face of said block.

14. The machine according to claim 10, wherein said support means for the scoop device comprise an elongate horizontal slide block fixed to the intermediate portion of said take off conduit member, and slidable longitudinally along a predetermined path, each end portion of said slide block having a longitudinally elongate vertical guide opening, a pair of upright bolts extending upwardly from said housing through respective guide openings in guiding relationship therewith incident to longitudinal sliding movement of said block, said bolts having head portions preventing upward displacement of said guide block, and an elongate cover plate in sliding contact with the top face of said guide block, and having a pair of openings penetrated by said bolts in fitted relationship therewith, whereby said cover plate is held in place relative to the movement of said guide block, and actuating devices combined with indicator means for applying controllable fine adjustment to said guide block, said indicator means comprising graduations provided on said cover plate, arranged to indicate the amount of longitudinal movement of said guide block relative to said graduations.

15. The machine according to claim 10, wherein said support means for the light fraction take off scoop device comprise an elongate slidge block fixed to the intermediate portion of said conduit member, and slidable longitudinally atop said housing, each end portion of said slide block having a longitudinally elongate vertical guide opening, and wherein a pair of upright bolts are provided extending upwardly from said housing through said elongate guide openings in guiding relationship therewith incident to longitudinal sliding movement of said block, said bolts having head portions preventing upward displacement of said block.

16. The machine according to claim 10, wherein said support means for the light fraction take off scoop device comprise an elongate slide block fixed to the intermediate portion of said conduit member, and slidable longitudinally atop said housing, each end portion of said slide block having a longitudinally elongate vertical guide opening, and wherein a pair of upright bolts are provided extending upwardly from said housing through said elongate guide openings in guide relationship therewith incident to longitudinal sliding movement of said block, said bolts having head portions preventing upward displacement of said blocks, and actuating means combined with indicator devices for applying controllable fine adjustment movement to said block.

17. The machine according to claim 16, with the addition of a screw spindle having its inner end turnably connected to one end of said slide member, horizontally coextensive therewith, and an internally threaded bearing block cooperating with said spindle to effect longitudinal movement of said slide member, controllable by the turning of said spindle.

18. The machine according to claim 10, wherein said support means for the light fraction take off scoop device comprise an elongate slide block fixed to the intermediate portion of said conduit member, and slidable longitudinally atop said housing, each end portion of said slide block having a longiudinally elongate vertical guide opening, wherein a pair of upright bolts are provided extending upwardly from said housing through said elongate guide openings in guide relationship therewith incident to longitudinal sliding movement of said block, said bolts having head portions preventing upward displacement of said blocks, and wherein said conduit member is countersunk into the lateral inner face of said block, and shaped to as to present a flat face substantially coextensive, with said inner lateral face of the block, and located adjacent to said rotor shaft.

19. The machine according to claim 10, wherein said support means for the light fraction take off scoop device comprise an elongate slide block fixed to the intermediate portion of said take-off conduit member, and slidable longitudinally atop said housing, each end portion of said slide block having a longitudinally elongate vertical guide opening, and and wherein a pair of upright bolts are provided extending upwardly from said housing through said elongate guide openings in guide relationship therewith incident to longitudinal sliding meovement of said block, said bolts having head portions preventing upward displacement of said block, with the addition of an elongate cover plate in sliding contact with the top face of said block, and having a pair of openings penetrated by said bolts in fitted relationship therewith, whereby said cover plate is held in place relative to movement of said block.

20. The machine according to claim 10, wherein said flow passage openings are located in the outer peripheral portion of said internal hub portion of the rotor bowl,

21. The machine according to claim 20, wherein said light fraction scoop device further comprises screw spindle means constructed and arranged for effecting controlled movement of said block.

22. The machine according to claim 20, wherein said take off conduit member is countersunk into the lateral inner face of said block.

23. The machine according to claim 20, wherein said take off conduit member is countersunk into the lateral inner face of said block, and shaped so as to present flat face substantially coextensive with said inner lateral face of the block, and located adjacent to the rotor shaft.

24. A nozzle type centrifugal machine with a vertical axis of rotation, operable for effecting the separation of a feed mixture into a light and heavy fraction and a nozzle discharge product, comprising a rotor having an upper open end, and a rotor shaft extending upwardly through said upper end, said rotor constructed and arranged for delivery of a light fraction from said upper end, and for overflow discharge of a heavy fraction at the lower end, and provided with nozzles spaced along the periphery intermediate said upper and lower ends for delivery of a nozzle product, and furthermore having a bottom feed opening for the introduction of said feed mixture into the rotor centrally from below, a stationary housing surrounding said rotor, having a top opening, separate means for separately collecting and discharging said heavy fraction overflow and the nozzle discharge product respectively, and a supply connection at the bottom for introducing said feed mixture upwardly into said bottom feed opening of the rotor.

and a light fraction take off scoop device comprising a take off conduit member extending through said top opening of the housing into said rotor, and formed with a lateral scoop portion at the lower end, arranged for skimming off an inner layer of said light fraction, while allowing the kinetic energy resulting from angular velocity to push such skimmed off light fraction material upwardly through said conduit member to discharge, an elongate slide block fixed to the intermediate portion of said take off conduit member, and slidable longitudinally atop said housing, guide means effective between said slide block and said housing and constructed and arranged for maintaining said slide block shiftable longitudinally along said path, said conduit member being unitary with said block thus being movable bodily on said housing parallel to itself in a horizontal plane, for adjustment of the skimming position of said scoop portion relative to said light fraction.

* * * * *